US006027373A

United States Patent [19]

Gray et al.

[11] Patent Number: 6,027,373

[45] **Date of Patent: *Feb. 22, 2000**

[54] ELECTRICAL CONNECTORS

[75] Inventors: Ian James Gray; Melvin Donald White, both of Winchester, United Kingdom

[73] Assignee: ITT Manufacturing Enterprises, Inc., Wilmington, Del.

[ * ] Notice: This patent is subject to a terminal disclaimer.

[21] Appl. No.: 09/078,073

[22] Filed: May 13, 1998

Related U.S. Application Data

[63] Continuation of application No. 08/767,841, Dec. 18, 1996, abandoned, which is a continuation of application No. 08/290,714, Dec. 27, 1994, Pat. No. 5,620,339, which is a continuation-in-part of application No. PCT/GB93/00142, Jan. 22, 1993.

[30] Foreign Application Priority Data

| | | | |
|---|---|---|---|
| Feb. 14, 1992 | [GB] | United Kingdom | 9203234 |
| May 14, 1992 | [GB] | United Kingdom | 9210375 |
| Nov. 13, 1992 | [GB] | United Kingdom | 9223824 |

[51] Int. Cl.[7] ..... H01R 9/05

[52] U.S. Cl. ..... 439/578; 439/584; 439/585; 439/784; 174/74 R; 174/75 R; 174/75 C

[58] Field of Search ..... 439/578–585, 439/752, 351, 352, 357, 395, 404, 851, 783, 784, 805–807; 174/74 R, 75 R, 75 C

[56] References Cited

U.S. PATENT DOCUMENTS 5,548,088 8/1996 Gray et al. ..... 439/578

*Primary Examiner*—Paula Bradley
*Assistant Examiner*—Tho Dac Ta
*Attorney, Agent, or Firm*—Thomas L. Peterson

[57] ABSTRACT

An electrical conductor terminating arrangement such as an electrical connector includes a contact-making element which makes good contact with an electrical conductor in response to axial pressure displacement over the contact-making element of a displaceable element to exert a radial force on the contact-making element and to co-operate therewith for providing ongoing pressure engagement between the contact-making element and the electrical conductor without the need for the continuance of axial pressure on the displaceable element after a predetermined axial displacement of the displaceable element.

5 Claims, 4 Drawing Sheets

ELECTRICAL CONNECTORS

CROSS REFERENCE TO RELATED CASE

Figures 1, 1A:
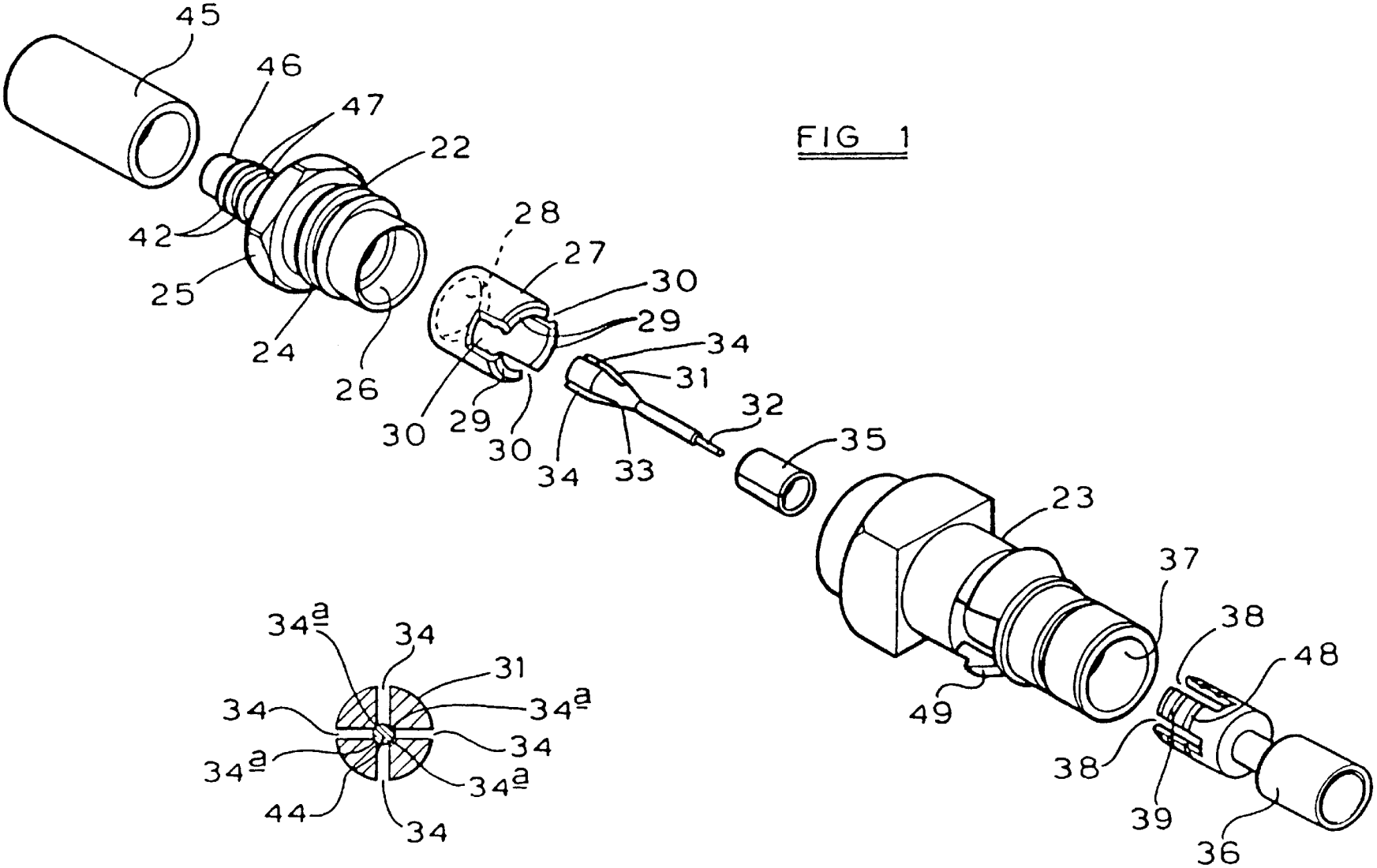

This is a continuation of Ser. No. 08/767,841 filed Dec. 18, 1996 now abandoned, which is a continuation of Ser. No. 08/290,714 filed Dec. 27, 1994 which issued as U.S. Pat. No. 5,620,339 on Apr. 15, 1997 which is a continuation-in-part of PCT/GB93/00142 filed Jan. 22, 1993.

This invention relates to electrical connectors.

The invention relates especially, but not exclusively, to electrical connectors of the coaxial type in which an electrical connection is made between the central conductor of an incoming coaxial cable and contact means of the connector without the need for crimping and/or other tools.

According to the present invention there is provided an electrical connector comprising a tubular body structure having an axially extending bore therein for receiving an incoming cable and for accommodating electrically conductive contact-making means located adjacent a part of the cable within the tubular body structure and electrically coupled with contact means (e.g. pin contact) of the connector, and axially displaceable means at least partly received by the tubular body structure and effective to cause the contact-making means to make good electrical contact with a conductor of the cable in response to a predetermined axial displacement of the displaceable means, in which the displaceable means has at least one positive hold position relative to the tubular body structure in which position the displaceable means acts solely to retain other connector components within the tubular body structure and in which the predetermined axial displacement of the displaceable means from the positive hold position to a further position also preferably a positive hold position, establishes electrical contact between the contact making means and the conductor of the cable.

The positive hold position of the displaceable means advantageously provides for security against loss of internal connector parts during handling, transport and/or delivery of the connector.

In carrying out the present invention the positive hold position(s) of the displaceable means may be provided by co-operating projection(s) and groove(s) formed in the axially displaceable means and another connector component part and making snap engagement with each other in the positive hold position(s). The axially displaceable means may be arranged to exert a radially inward force on a contact-making element of the contact-making means to make good electrical contact with the conductor of the cable in response to the aforesaid predetermined axial displacement of the axially displaceable means.

The contact-making element may comprise a compressible clamping element adapted to fit over a bared part of the conductor within the tubular body structure of the connector and electrically coupled with the contact means (e.g. pin contact) of the connector. The axially displaceable means in response to movement thereof exerts a radially-inward compressive force on the clamping element to cause it to clamp down on to the conductor.

The compressible clamping element may comprise a split tubular metal part into one end of which the bared part of the conductor extends and this clamping element may be formed integrally with the contact means (e.g. pin contact) of the connector.

To positively ensure good electrical contact between the compressible clamping element and the bared conductor the actual conductor clamping region of the element may be screw-threaded or otherwise configured to bite into the outer surface of the conductor as clamping takes place.

The compressible clamping element may, for example, be provided with radial slots which have a width less than the diameter of the central diameter and which present at the periphery of a central passage in the element for slidingly receiving the conductor, sharp edges to bite into the outer surface of the conductor to make good contact therewith when the clamping element is compressed. Four such radial slots may be provided to afford a passageway of cruciform configuration. A six slot construction of clamping element is also especially contemplated.

The compressible clamping element may be stepped on its inner surface in order to accommodate conductors of different diameters.

The axially displaceable means for exerting the radial compressive force on the clamping element may include a resilient sleeve member which initially progressively envelops the split clamping element compressing it radially inwards in response to axial displacement of the displaceable means towards the rear of the connector from the first positive hold position of the displaceable means. The resilient sleeve member may be provided by a split metal ring or by forming the sleeve of inherent resilient material (e.g. plastics material). The resilient sleeve may be engaged by, attached to, or formed integrally with a tubular insulating member which is slidably mounted in the bore of the tubular body structure at the contact end of the connector. The contact means may be coupled to a relatively large diameter clamping element by a split frusto-conical section which facilitates smooth and easy transition of the resilient sleeve member from the cone surface on to the outer periphery of the clamping element in order to compress the element radially inwards when the front end of the tubular insulating member is displaced axially towards the rear end of the connector. Displacement of the tubular insulating member may, for example, be arrested once the resilient sleeve member is positioned over the clamping element, as by the abutment of the rear end portion of the member with shoulder means of a cup-shaped insulating stop member located within the bore of the tubular member and having a tapered opening therethrough for the passage of the conductor of the cable.

It is also contemplated that the axially displaceable means may include a rigid or non-resilient sleeve member which may be engaged by, or attached to, a tubular insulating member slidably mounted in the bore of the tubular body structure at the contact end of the connector and which moves over resilient contact-making means in order to exert thereon an inward pressure to cause the resilient contact-making means to make pressure engagement with the conductor of the cable.

In the case of a resilient sleeve member or a non-resilient sleeve member, the sleeve member and the contact-making means co-operate when the sleeve member is fully positioned thereon to provide ongoing pressure engagement between the contact-making means and the conductor of the cable without the need for a continuing applied axial force on the sleeve member of the axially displaceable means.

The connector construction of the present invention is especially applicable to co-axial connectors for clamping down on to the central conductor of a coaxial cable but it should be understood that it could be used for making connections to the conductor or conductors of other cables by way of single or multi-way non-coaxial connectors.

For the purpose of gripping the incoming cable (e.g. coaxial cable) at the end of the connector where the cable enters a suitable strain-relief arrangement may be provided.

Figure 2:
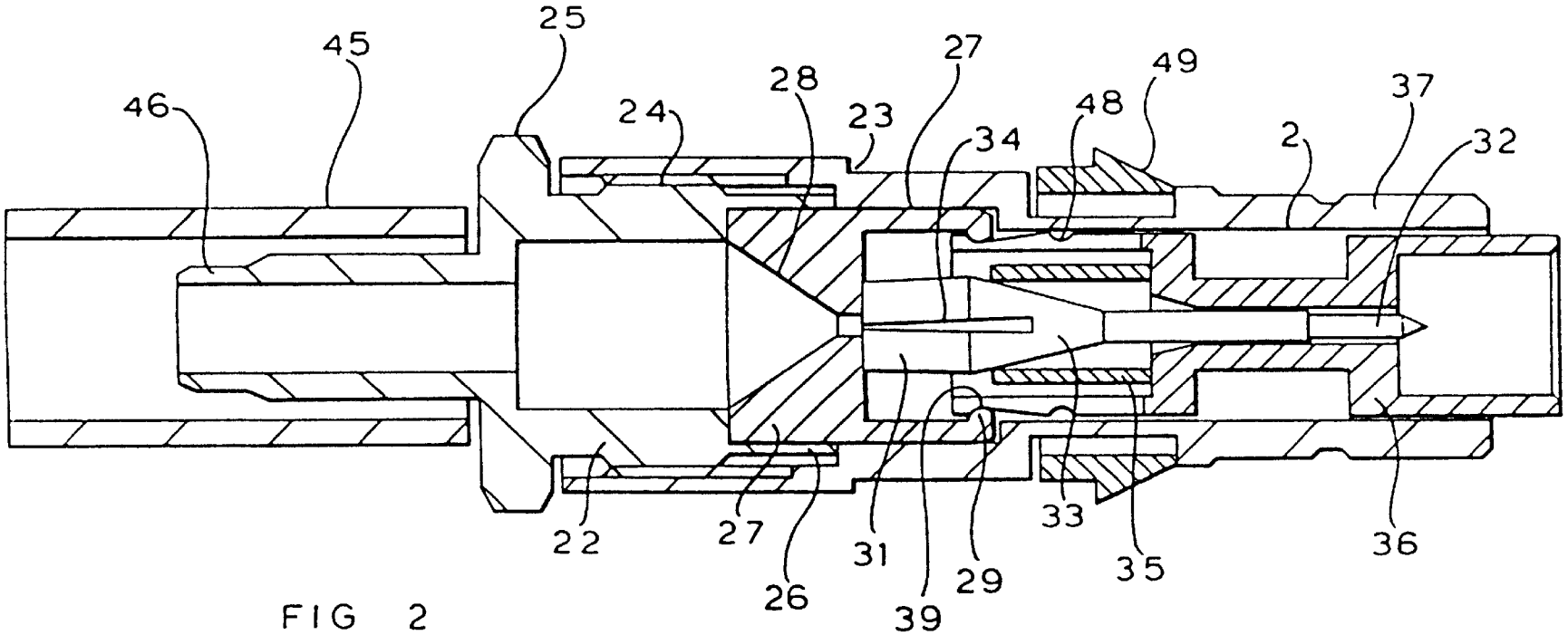
Figure 3A:
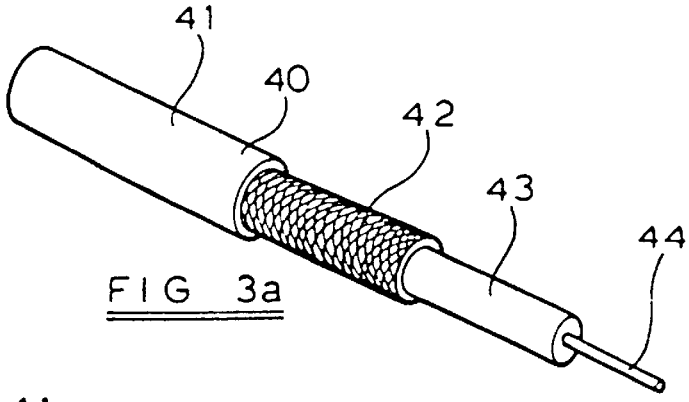
Figure 4:
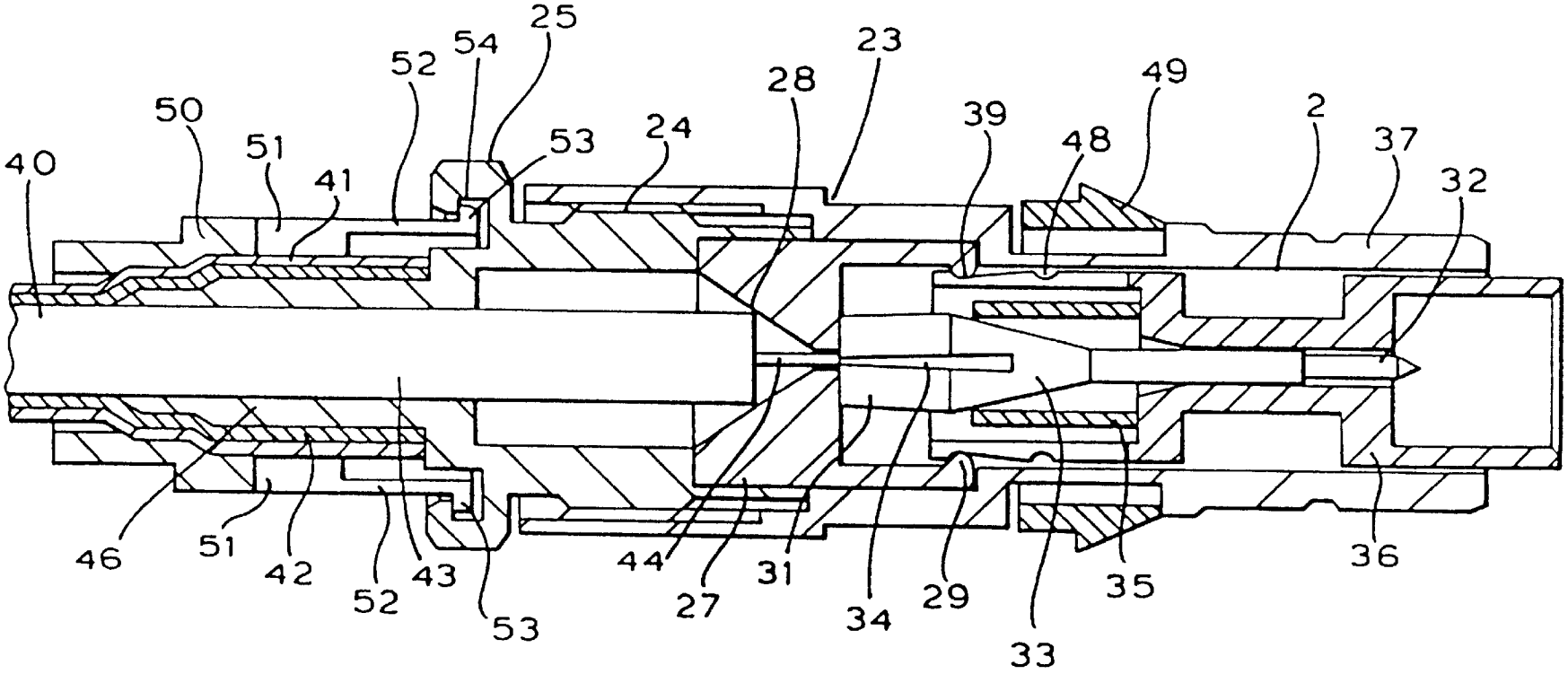

By way of example the present invention will now be described with reference to the accompanying drawings in which:

FIG. 1 shows an exploded view of a coaxial cable connector according to the present invention;

FIG. 1*a* shows an enlarged detail of FIG. 1;

FIG. 2 shows a longitudinal cross-sectional view of an assembled coaxial cable connector substantially as shown in exploded form in FIG. 1;

FIGS. 3*a,* 3*b* and 3*c* show different steps in the connection of an incoming cable to the connector of FIG. 1; and FIG. 4 shows a longitudinal cross-sectional view of another coaxial cable connector similar to that of FIG. 2 but having a different cable strain relief arrangement.

Referring to FIG. 1 of the drawings, the embodiment depicted therein in exploded form comprises a coaxial connector facilitating a pre-conductor clamping assembled state. Forward and rearward directions are indicated by arrow F, R.

The tubular body structure of the connector comprises two generally cylindrical metal parts 22 and 23, the body part 22 having an externally-threaded portion 24 which, as facilitated by the integral nut head 25, can be screwed into an internally-threaded portion (not shown) of the body part 23. The body part 22 includes a cylindrical cavity 26 which slidingly receives a hollow cylindrical latching member 27 of electrically insulating material. The end of the latching member 27 which engages the base of the cavity 26 is provided with a conical recess 28 against the surface of which the end of the dielectric layer of an incoming coaxial cable to the connector will abut, as will later be apparent. The right-hand end of the latching member 27 is provided with a radially inwardly extending lip or projection 29 and, although in the present embodiment the latching member 27 is rendered radially resilient by the provision of slots 30, it should be understood that this may not be necessary, as will hereinafter become apparent.

The latching member 27 is adapted to receive the end of a split radially compressible metal clamping collet 31 which, in the present embodiment is formed integrally with a contact 32 (e.g. pin contact) of the connector connected to the collet 31 by a split conical, or tapered, section 33. The surfaces where the tapered section 33 engages a split ring clamping member 35 formed a tapered interface. The internal periphery of the clamping collet may be threaded or provided with serrations or surface irregularities or otherwise configured in order to bite into the outer surface of the single or stranded central conductor of the coaxial cable during a conductor clamping operation. In the present embodiment the metal clamping collet 31, as can best be seen from FIG. 1*a* of the drawings, is split axially by means of four radial slots 34 which define four tines a cruciform passageway extending axially through the collet and providing four axially extending sharp corners or edges 34*a* towards the centre of the passageway where clamping of central conductor 44 takes place. It is well known that collets preferably have at least three tines to center an object held by the collet. The width of the radial slots 34 will be less than the diameter of the central conductor but the central passage or region of the cruciform passageway will be sufficiently large to slidingly receive a wire conductor that forms an inner or central conductor 44 before radial compression of the collet 31 takes place to effect clamping of the conductor. During such conductor clamping the axially extending sharp edges 34*a* of the collet 31 will bite into the conductor 44 in order to ensure good electrical contact therewith. As will readily be apparent, other multi-slot collet constructions could alternatively be provided to achieve a similar result. A six slot collet construction is also especially contemplated.

A clamping member in the form of a resilient split metal ring 35 is provided for co-operating with the collet 31 to effect radial compression thereof to effect clamping engagement with the central conductor 44 (FIG. 1*a*). To achieve such compression, a tubular axially-displaceable member or axially displaceable pusher element 36 of insulating material is provided. The displaceable member 36 is slidably received in a through bore 37 of the connector body part 23 and when the two body parts 22 and 23 are secured together with the collet 31 and the co-operating split clamping ring 35 located within the internal cylindrical cavity of the body structure, the member 36 can readily be displaced axially simply by exerting pressure on the front end, or right-hand end thereof, as viewed in the drawing, so that the radially flexible slotted rear end of the member 36 defined by slots 38 first makes snap engagement with the tubular latching member 27 by the engagement of the lip or projection 29 on the member 27 with an external circumferential groove 29 in the slotted end of the displaceable member 36. It will be appreciated that with the latching member 27 slotted, as shown, the slots 38 in the member 36 could be dispensed with. As will readily be appreciated from FIG. 2 of the drawings which shows a connector very similar to the exploded connector of FIG. 1 but in an assembled state prior to clamping of the central cable conductor, component parts of the connector are securely held in situ by the initial latching arrangement provided between the members 27 and 36. Such an arrangement importantly enables connectors to be handled and/or transported/delivered in readiness for cable connection and conductor clamping without the risk of connector parts becoming detached or lost.

Figure 3B:
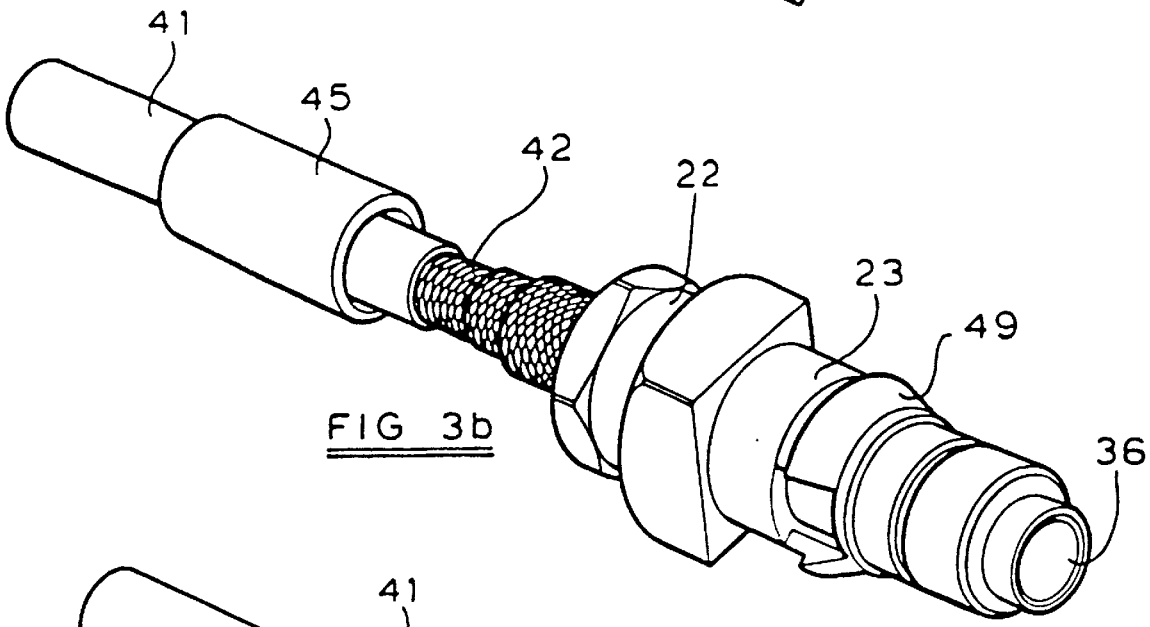

In order to connect the assembled connector to a coaxial cable, as shown at 40 in FIG. 3*a* of the drawings, the usual outer insulation sleeve 41 will be cut back, as shown, to expose a suitable length of an underlying metal braided screen 42 which forms an outer coaxial conductor. The metal braid will then be stripped back, as shown, over a requisite length to leave a length of extruded dielectric insulation 43 exposed. This dielectric will then be cut back to leave a length of bared central, or coaxial inner conductor 44. The cable end will then be inserted through a metal crimping ferrule, shown at 45 in FIGS. 1 and 3*b,* and then into the cable receiving end of the body part 22 which is already screwed to the body part 23 in the pre-conductor clamping assembled state of the connector. The body part 22 has a tubular extension 46 which may have circumferential ridges 47 so that as the cable moves into the interior of the connector the ridged extension 46 will be urged between the dielectric layer 43 and the metal braiding sleeve 42 of the cable, as shown in FIG. 3*b,* whilst the bared end 44 of the central conductor will move into and along the central passage of the clamping collet 31 as indicated in FIG. 1*a* or the drawings, until the forward end of the exposed dielectric material 43 abuts against the conical surface of the recess 28 provided in the latching member 27.

To effect clamping of the collet 31 to the central conductor 44 of the incoming cable 40, the axially displaceable element or member 36 is simply pressed from its initial pre-clamping in the rearward direction R, from the front of the connector, further into the bore 37, as a result of which the split clamping ring 35 will be forced by the displacement member 36 over the cylindrical surface of the split collet 31 which is accordingly compressed radially inwards so that the inner axially extending sharp edges 34*a,* as shown in FIG. 1*a,* bite into the outer surface of the single or stranded central conductor in order to make good electrical contact therewith. When sufficient clamping force has been exerted on the collet 31 by movement of the clamping ring 35, the displaceable member 36 makes a second and final snap engagement with the latching member 27 by the engagement of a second circumferential groove 48 in the member 36 with the inturned lip or projection 29 on the latching member 27. In this position of the displaceable member 36 the components of the connector are in the conductor clamped assembled state and the resilient split clamping ring 35 co-operates with the collet 31 to provide an ongoing pressure engagement between the collet and the central conductor 44 without the need for a continuing axially applied force to the ring 35. In this state of the connector the cable may be pulled to carry out a tensile test for ensuring that effective clamping of the central conductor has been achieved.

It is contemplated that the members 27 and 36 could be composed of a transparent insulating material which would enable a conductor clamp connection to be viewed after unscrewing the two body parts 22 and 23.

Although in the embodiments described with reference to FIGS. 1 to 4 the sleeve member 35 comprises a resilient split ring 35 which co-operates with the clamping element 31 to provide ongoing pressure engagement with the central conductor 44 it will be appreciated, as already mentioned, that the resilient sleeve member 35 could be replaced by a non-resilient sleeve member which co-operates with resilient contact-making means over which the sleeve member fits to provide the ongoing pressure engagement between the contact-making means and the central conductor of the coaxial cable.

As will be apparent, once the resilient or non-resilient sleeve member has been moved over the contact-making means the insulating displacement member and other parts of the connector could be removed without unclamping of the central conductor.

Figure 3C:
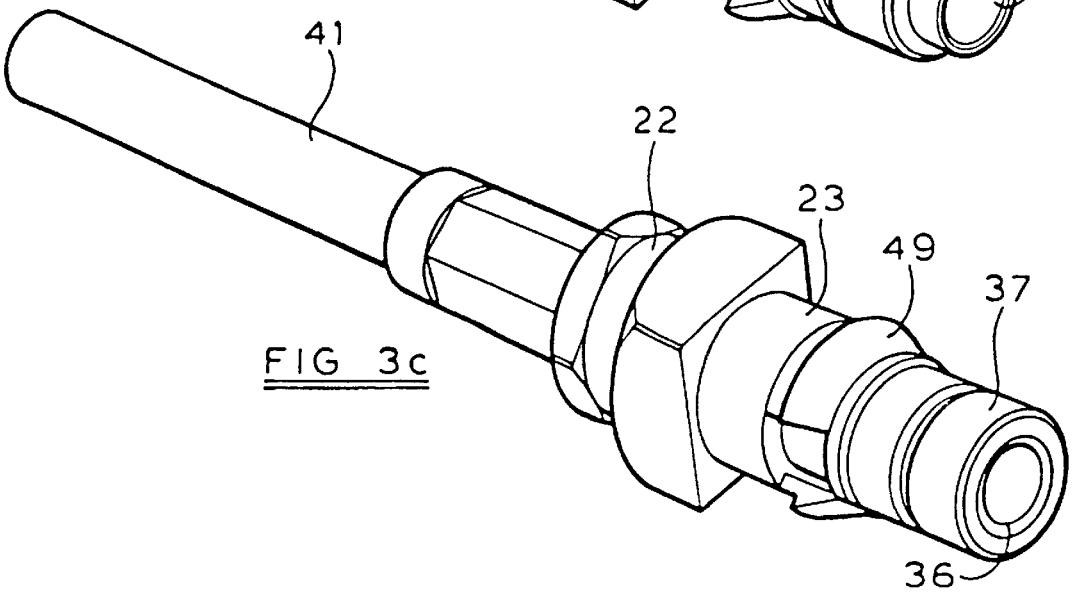

In order to complete the strain relief connection between the incoming cable 40 and the connector, the metal ferrule 45 may be positioned over the metal braiding overlying the tubular ridged extension 46, as can be seen in FIG. 1 of the drawings, and then crimped down on to the braiding, as shown in FIG. 3*c.*

To enable the connector to be panel mounted, a radially collapsible ring 49 may be fitted in a groove of the body part 23. The configuration of the ring allows the contact end of the connector to be inserted into a panel aperture after which the ring restores to hold the connector in position.

Referring finally to FIG. 4 of the drawings this shows a coaxial cable connector which is identical to that shown in FIG. 3 apart from the cable strain relief arrangement.

After suitable stripping back of the outer insulation sleeve 41 and braiding 42 of the cable 40, as shown the stepped tubular extension 46 will be forced between and effect separation of the inner dielectric layer 43 from the braiding 42 so that the separated outer layers of the cable extend over the extension 46. A stepped clamping bush 50 which has radial slots 51 defining resilient arms 52 is then pressed over the extension 46 so that latches 53 at the ends of the arms 52 make snap engagement with an internal groove 54 provided in the nut 25. In this position of the clamping bush 50, the incoming cable is firmly clamped relative to the connector body structure to prevent straining of the central conductor 44 which is clamped to the clamping element/contact 32,33.

Although the invention has been specifically described as applies to a coaxial connector it will readily be apparent that it could be applied to single or multi-way non-coaxial connectors.

We claim:

1. A coaxial connector for connecting to a coaxial cable that has an outer conductor and a central coaxial wire conductor, comprising:

a body structure constructed to engage the outer conductor of the coaxial cable, said body structure having an axis and having a bore that extends completely through said body structure along said axis, with said bore having front and rear bore ends and with said rear bore end constructed to receive part of said cable;

a contact member lying in said bore, said contact member having a contact mateable front portion and having a contact rear portion that is integral with said contact mateable front portion, said contact rear portion being primarily in the form of a tube having an inner surface for receiving the central coaxial wire conductor of the coaxial cable and having an outer surface, and said contact rear portion having a plurality of slots that form a plurality of tines which are deflectable to clamp to said central coaxial wire conductor;

a clamping member lying in said bore;

at least one of said members being movable relative to the other of said members along said axis, to cause a part of said clamping member to directly engage against a part of said contact rear portion, with said members forming a tapered interface where said members directly engage each other so as said parts move one against the other said clamping member compresses said contact rear portion to cause said tines of said contact rear portion to move closer together to clamp to said wire conductor;

an axially displaceable pusher element that is accessible from the front end of said bore around said contact mateable front portion and that is axially slidable in said bore, said pusher element having a rear end engaged with a first of said members so as said pusher element is forced to slide rearwardly it pushes said first member rearwardly to move said parts of said contact member and said clamping member against one another.

2. A coaxial connector for connecting to a coaxial cable that has an outer conductor and a central coaxial wire conductor, comprising:

a body structure having a bore with an axis, said body structure including at least one conductive body element constructed to engage the outer conductor of the coaxial cable;

a contact member lying in said bore, said contact member having a pin front portion and having a contact rear portion that is integral with said pin front portion, said contact rear portion being primarily in the form of a tube having an inner surface for receiving the central conductor of the coaxial cable and having an outer surface, and said contact rear portion having a plurality of slots that form a plurality of fines which are deflectable to clamp to said wire conductor with said tines having rear ends with narrowed means for applying concentrated forces to the wire conductor;

a clamping member lying in said bore;

at least one of said members being movable relative to the other of said members along said axis, to cause a part of said clamping member to directly engage against a part of said contact rear portion, with said members forming a tapered interface where said members directly engage each other so as said parts move one against the other said clamping member compresses said contact rear portion to cause said tines of said contact rear portion to move closer together to clamp to said wire conductor;

said contact member being of rigid construction except for said tines, and said clamping member being of rigid construction.

3. A coaxial electrical connector for connecting to a coaxial cable having cable inner and outer conductors, wherein said connector includes a conductive body structure having a bore with an axis with said conductive body structure being connectable to said cable outer conductor, including:

an axially displaceable pusher element lying in said bore and having a contact-holding passage;

a contact member lying in said passage of said axially displaceable pusher element, said contact member having a mateable front portion and having a largely tubular rear portion with an inside surface for receiving said cable inner conductor, and said rear portion having a plurality of slots forming at least three tines which are deflectable to clamp to said inner conductor;

a clamping member lying in said bore;

one of said members being movable along said axis toward the other of said members and said members forming a tapered interface between said members and said members positioned to directly engage each other at said tapered interface to cause a clamping portion on said clamping member to compress said contact member rear portion so said tines of said contact rear portion clamp to said cable inner conductor, with both of said member portions being rigid;

said axially displaceable pusher element being slidable axially along said bore and having a surface positioned to push against one of said members which is moveable, so when said axially displaceable pusher element is moved rearwardly along said axis it pushes said one of said members which is moveable against said other of said members to cause said clamping member to compress said contact member rear portion.

4. A method for use with a coaxial cable that has outer and inner conductors, and an electrical connector which has a body structure that has a bore with an axis and that is connected to said cable outer conductor, for terminating said inner conductor so it can be mated to a contact element of another connector, comprising:

positioning within said bore, a contact member that has a slotted tubular rear part forming tines and that has a front part forming a mateable contact end for mating to the contact element of said another connector, positioning a metal clamping member in said bore with said members having surfaces forming a tapered interface between them and said surfaces positioned to directly engage each other at said tapered interface, with one of said surfaces lying on said slotted tubular rear part of said contact member, inserting said inner conductor into said tubular rear part of said contact member, moving one of said members relative to the other along said axis so said surfaces engage each other to compress said slotted tubular rear part and cause said tines to grip said inner conductor without compressing said metal clamping member.

5. The method described in claim 4, including:

positioning a pushing element in said bore, with a passageway extending along said axis, and with said contact member lying in said pusher element;

pushing said pusher element rearwardly along said axis and against said one of said members to push said one of said members rearwardly against said other of said members.

* * * * *